US006087641A

United States Patent [19]

Kinouchi et al.

[11] Patent Number: 6,087,641

[45] Date of Patent: Jul. 11, 2000

[54] FIXING DEVICE WITH INDUCTION HEATING UNIT

[75] Inventors: Satoshi Kinouchi; Osamu Takagi, both of Tokyo, Japan

[73] Assignee: Kabushiki Kaisha Toshiba, Kawasaki, Japan

[21] Appl. No.: 09/116,545

[22] Filed: Jul. 16, 1998

[30] Foreign Application Priority Data

Jul. 16, 1997 [JP] Japan ..... 9-191444

[51] Int. Cl.[7] ..... H05B 6/14; H05B 6/08; G03G 15/20

[52] U.S. Cl. ..... 219/619; 219/667; 219/670; 399/330; 399/67; 399/69

[58] Field of Search ..... 219/619, 667, 219/670, 469, 470, 471; 399/328, 329, 330, 331, 67, 69

[56] References Cited

U.S. PATENT DOCUMENTS

| | | | |
|---|---|---|---|
| 5,278,618 | 1/1994 | Mitani et al. | 219/216 |
| 5,325,164 | 6/1994 | Tai et al. | 399/322 |
| 5,432,593 | 7/1995 | Nishikawa et al. | 399/290 |
| 5,552,582 | 9/1996 | Abe et al. | 219/619 |
| 5,689,756 | 11/1997 | Taki et al. | 399/33 |
| 5,713,069 | 1/1998 | Kato | 399/330 |
| 5,778,293 | 7/1998 | Ohtsuka | 399/329 |
| 5,819,150 | 10/1998 | Hayasaki et al. | 399/330 |
| 5,862,445 | 1/1999 | Ogawa et al. | 219/619 |
| 5,881,349 | 3/1999 | Nanataki et al. | 399/328 |
| 6,002,909 | 12/1999 | Furuyama et al. | 399/328 |

FOREIGN PATENT DOCUMENTS

| | | |
|---|---|---|
| 8-16005 | 1/1996 | Japan . |
| 8-44227 | 2/1996 | Japan . |
| 9-197869 | 7/1997 | Japan . |

*Primary Examiner*—Philip H. Leung
*Attorney, Agent, or Firm*—Foley & Lardner

[57] ABSTRACT

A fixing device is provided, which can maintain good fixing properties, irrespective of the kind of a material on which a developer image is to be fixed and a temperature condition of a pressure roller. In a rotary contact region between a heat supply medium and the pressure roller, pressure and heat are applied to the material, thereby fixing the developer image on the material. The heat supply medium includes a metallic body for induction heating, which is provided with a magnetic field to produce an eddy current. The heat supply medium contains a magnetic field generating unit. The magnetic field generating unit includes a core provided with a coil. The core is situated near the metallic body of the heat supply medium such that a distance between a position closest to the metallic body and an end portion of the core is less than a distance between magnetic force line guiding portions provided on the core. The coil is wound such that the coil is not closer to the metallic body than a region surrounded by the magnetic force line guiding portions in a direction of cross section of the core.

16 Claims, 10 Drawing Sheets

FIXING DEVICE WITH INDUCTION HEATING UNIT

BACKGROUND OF THE INVENTION

The present invention relates to a fixing device for use in an image forming apparatus, which fixes a developer image formed on an object, thereby obtaining a fixed image.

In a fixing device built in a copying apparatus using an electrophotographic process, a developer image or a developer on a material subjected to a fixing process is heated and melted, and the developer is fixed on the material.

As methods of heating the developer, there are conventionally known a method of using a halogen lamp (a filament lamp utilizing resistor heating) and a method of using a flash light type lamp (a discharge lamp in which power is converted to heat energy). The method of using the flash light type lamp is not widely used. In addition to the method of converting power to heat energy with use of a lamp, there is known an induction heating method of producing heat by supplying a current to a magnetic field.

In the method of using the halogen lamp as heating source, such a structure is widely used that a tubular halogen lamp is disposed within at least one of a pair of rollers, which is formed in a hollow cylindrical shape, the rollers being capable of applying pressure to the material on which the developer is to be fixed and to the developer. In this structure, the roller in which the halogen lamp is disposed forms an operating portion (rotary contact portion) at a position contacting the other roller, and pressure and heat is applied to the material (and developer) guided to the rotary contact portion.

In many cases, the roller in which the halogen lamp is disposed is formed of a metal in order to maintain heat conduction. The other roller is formed of elastic material so that it may come into close contact with the metal roller at the rotary contact portion for contact with the metal roller.

When the material on which the developer is to be fixed passes by the rotary contact portion, the material receives heat mainly from the metallic roller. When the material is pressed on the metallic roller by the roller with elasticity, the thermally melted developer is captured and thus the developer is fixed on the material.

In the fixing device using the above roller, electrical energy is converted to light and heat and transmitted to the metallic roller by radiation. Subsequently, the outer periphery of the metallic roller is heated by conduction and predetermined heat is supplied to the material. Thus, the heat use efficiency is about 70%. Besides, since the roller is heated from inside, a great deal of time and power is required to raise the temperature of the outer periphery of the roller up to a temperature (e.g. 180° C.) necessary for fixing the developer on the material. The surface temperature of the metallic roller is controlled at a target temperature by operating a switching element provided in a power supply device to turn on/off power voltage to the lamp, on the basis of the temperature detected by a thermistor or temperature sensing means.

However, in a case where the power supply voltage to the lamp is controlled by sensing the surface temperature of the metallic roller, even if the power is shut off at the time when the target temperature has just been reached, the temperature overshoots the target temperature due to the thickness of the roller. For example, there may occur such an offset phenomenon that a developer on the roller, which is applied in the first rotation of the roller, is transferred on the image on the roller which is applied in the second rotation of the roller.

In order to shorten the time needed to raise the surface temperature of the roller and to decrease a difference between the surface temperature and the target temperature, there is known a method of thinning the metallic roller and reducing the thermal capacity. On the other hand, when a thin roller is used, a local temperature variation occurs in the axial direction of the roller in association with the size of the material or recording sheet. Besides, when the number of recording sheets on which developer is to be fixed is plural and the sheets are successively fed to the rotary contact portion, the temperature of the outer periphery of the roller varies in association with the order of fed sheets and consequently a fixing ratio indicating the degree of attachment of developer on sheets varies.

As has been described above, the reduction in thickness of the metallic roller requires an intricate control for preventing a local temperature variation in the axial direction of the roller or a structure of the halogen lamp capable of providing different temperatures in the length direction of the roller. In addition, in order to prevent a variation in fixing ratio due to successive feeding of sheets, it is necessary to provide a margin to the maximum value of heat amount which can be produced by the halogen lamp or to provide a plurality of halogen lamps and vary the number of lamps to be turned on.

These measures inevitably lead to an increase in the cost of the fixing device (copying apparatus).

Examples of the fixing device using induction heating are described in Jpn. Pat. Appln. KOKAI Publication No. 8-16005 and Jpn. Pat. Appln. KOKAI Publication No. 8-44227.

The induction heating device includes a coil for supplying electric current to produce a predetermined magnetic field and a core bent toward the rotary contact portion in order to collect at the rotary contact portion the magnetic field produced by the current supplied to the coil. There is a problem, however, in that the magnetic field produced by the current supplied to the coil is symmetric with respect to an axis connecting the center of the core and the center of the rotary contact portion and thus the center of generated heat distribution does not coincide with the center of the rotary contact portion and the generated heat distribution exhibits two peaks on the upstream and downstream sides in the direction in which the material on which developer is fixed is fed, and not at the center of the rotary contact portion. In this case, the amount of heat that can be used at the rotary contact portion decreases and as a result the efficiency of use of current (electric energy) supplied to the coil deteriorates.

Furthermore, since the coil is disposed on a side of the core closer to the rotary contact portion and on the opposite side of the core, with the core sandwiched by the coil, a region farthest from the rotary contact portion between the elastic roller and the belt is heated undesirably.

BRIEF SUMMARY OF THE INVENTION

An object of the present invention is to provide a fixing device capable of maintaining good fixing state, irrespective of the kind of a material on which developer is to be fixed or the temperature condition of a pressure roller.

Another object of the invention is to provide a fixing device using an induction heating source as a heating source, wherein a generated heat distribution is concentrated at one point to enhance a heat production efficiency and a variation in a temperature attained by generated heat is reduced.

According to the present invention, there is provided a fixing device comprising:

a first rotary contact member formed of an electrically conductive material and rotated in a predetermined direction;

a second rotary contact member put in contact with the first rotary contact member under a predetermined pressure, a rotary contact region for fixing a developer image on a material on which the developer image is to be formed being formed between the first rotary contact member and the second rotary contact member;

induction heating means, provided on a side of one of the first rotary contact member and the second rotary contact member, for induction-heating the rotary contact region; and control means for controlling the induction heating means so that the rotary contact region has a predetermined temperature.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

Figure 1:
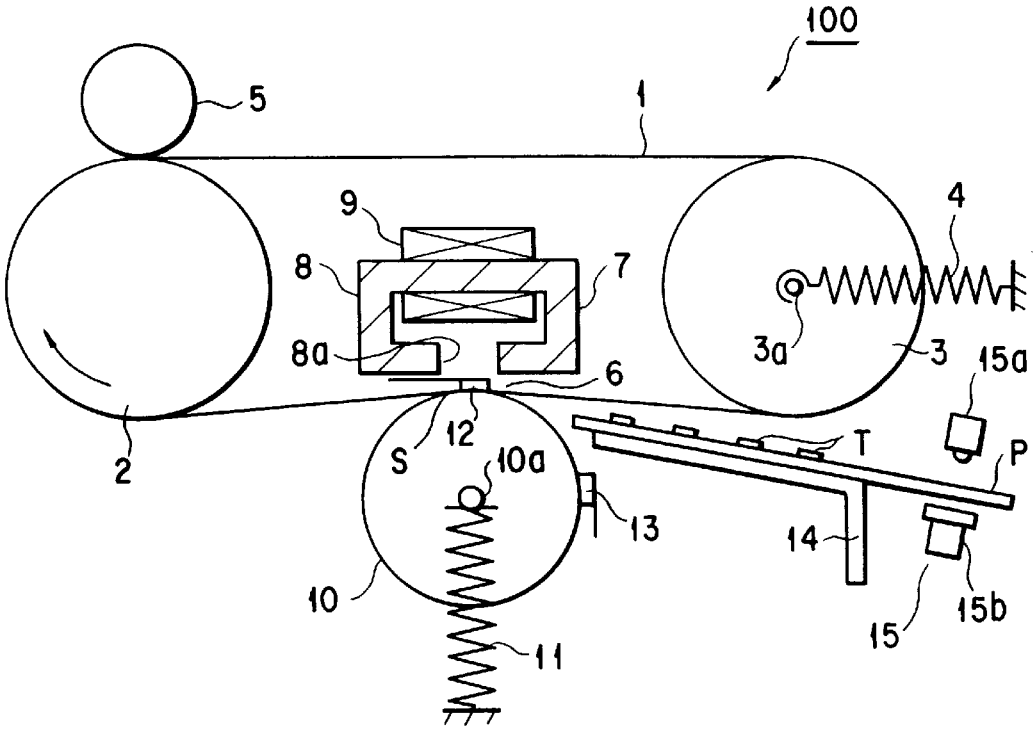
FIG. 1 is a schematic view showing a fixing device according to a first embodiment of the invention.

FIG. 1 shows a fixing device according to a first embodiment of the invention for an electrophotographic type image forming apparatus.

A fixing device 100 has a fixing belt 1 or a first rotary contact member formed of an electrically conductive material. The fixing belt 1 is obtained by forming a ferromagnetic metallic material, typically conductive Ni (nickel) or iron containing a group of stainless steel, in a film shape with a predetermined thickness. In this embodiment, the thickness of the belt 1 is set at 50 $\mu$m and the belt 1 is formed by electroplating. A separation layer for preventing adhesion of a developing agent (toner), for example, a layer of a fluororesin, silicone resin or silicone rubber, may be coated on the surface of the fixing belt 1 to a predetermined thickness.

The fixing belt 1 can be rotated by a driving source (not shown) at a predetermined rotational speed. The fixing belt 1 is passed between a driving roller 2 with a diameter of 25 mm and a driven roller 3 with a diameter of 25 mm. The fixing belt 1 thus rotates in a predetermined direction, following the rotation of the roller 2. A free end portion of an extension spring 4 fixed to a predetermined position is attached to a shaft 3a of the driven roller 3. The driven roller 3 is thus urged by the spring 4 to apply a predetermined tensile force to the fixing belt 1. The tensile force applied by the spring 4 prevents the fixing belt 1 from slipping despite the driving roller 2 being rotated.

An oil applying device 5 for applying oil to the belt 1 to reduce the possibility of adhesion of toner on the belt 1 is disposed at a position on the outer surface side of the fixing belt 1, facing the driving roller 2. The oil applying device 5 comprises an oil coating roller put in contact with the fixing belt 1 and rotated along with the fixing belt 1, and an oil supplying mechanism (not shown) for supplying oil to the coating roller.

An induction heating unit (magnetism generator) 7 for heating the belt 1 by induction heating is disposed on the inner surface side of the fixing belt 1, with a predetermined gap 6 provided between the belt 1 and itself. The heating unit 7 is connected to a radio-frequency output unit which will be described later with reference to FIG. 3.

The magnetism generator 7 has an opening 8*a* formed by removing a portion thereof opposed to the inner surface of the fixing belt 1. The magnetism generator 7 includes a hollow magnetic yoke (core) 8 with a rectangular cross-sectional shape and a coil 9 wound around an inside and an outside of a predetermined portion of the core 8. The coil 9 is formed of, e.g. a copper wire with a cross-sectional diameter of 1.4 mm.

A pressure roller 10 having a diameter of, e.g. 20 mm, being able to be in contact with the fixing belt 1 and being rotatable in a predetermined direction is disposed on the opening 8*a* side of the core 8 (on the outer surface side of belt 1), with the fixing belt 1 interposed. The pressure roller 10 is pushed up toward the fixing belt 1 by a predetermined force by a pressing spring 11 acting on a central shaft 10*a* of roller 10. Thus, a rotary contact portion S also called a contact portion or a nip portion, where the outer peripheral surface of roller 10 is in contact with the belt 1 is provided. The rotary contact portion S extends by a predetermined distance on the upstream and downstream side in the direction in which the belt 1 is rotated. The width of rotary contact portion S (the dimension of the area where the pressure roller 10 is in contact with the belt 1) is set at a proper value in accordance with the pressure applied to the pressure roller 10 by the pressing spring 11. The type of pressure roller 10 in this embodiment is "elastic", and the elastic roller 10 is obtained by forming silicon rubber, etc. on the shaft 10*a* to a predetermined thickness. The roller 10, however, may be a "solid" i roller formed entirely of a metal.

A thermistor 12 for sensing the temperature of belt 1 is provided in contact with the inner surface of the fixing belt 1 at a position where the outer surface of the belt 1 is put in contact with the pressure roller 10, that is, a position where the rotary contact portion is formed by the opening da of the core of magnetism generator 7 and the pressure roller 10 and where an inwardly curved portion of belt 1 is opposed to the pressure roller 10. In addition, another thermistor 13 for sensing the temperature of the pressure roller 10 is disposed in contact with the outer peripheral surface of pressure roller 10.

In the above-described fixing device 100, when a driving force is applied from the driving source (not shown) and the driving roller 2 is rotated in the direction of the arrow, the fixing belt 1 is continuously rotated at the same speed as the speed at which the outer peripheral surface of the driving roller 2 moves. The driven roller 3, the applying roller of oil applying device 5 and pressure roller 10 are also rotated, following the rotation of fixing belt 1.

A plain paper sheet or a transparent resin sheet (OHP sheet) for an over-head projector P, on which a developer image or a toner image T to be fixed is electrostatically carried, is guided along a convey guide 14 to the rotary contact portion S formed by the fixing belt 1 and pressure roller 10. A material sensor 15 including a light emission element 15*a* and a light reception element 15*b* and functioning to sense the kind of sheet P guided to the rotary contact portion S along the convey guide 14 is provided at a predetermined position along the convey guide 14. The material of sheet P guided to the rotary contact portion S is identified by the material sensor 15. The magnetism generator 7 generates a magnetic field of a predetermined magnitude on the basis of a drive current set by the relationship between the material, sensed by the sensor 15, and the fixing temperature, which relation ship is stored in a memory device (to be described later with reference to FIG. 3). Thereby, the magnetism generator 7 raises the temperature of the fixing belt 1, which is passing through the rotary contact portion S, up to a predetermined level.

The sheet P, which has been guided to the rotary contact portion S, passes through the rotary contact portion S while carrying a molten toner image formed by contact between the toner of a toner image on the sheet P itself and the fixing belt 1. At this time, a predetermined pressure is applied to the molten toner image by the fixing belt 1 and pressure roller 10. Thus, the toner image is fixed on the sheet.

Figure 2:
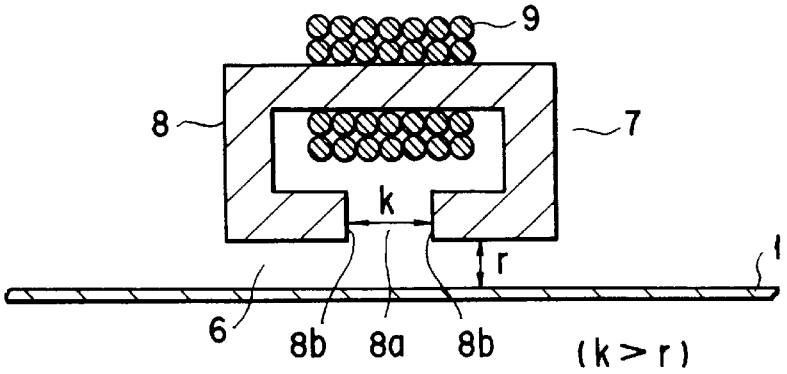
FIG. 2 is a cross-sectional view showing a magnetism generator built in the fixing device shown in FIG. 1.

FIG. 2 is a schematic view for describing the structure of the magnetism generator 7.

The core 8 of the magnetism generator 7 is formed of a material with a high magnetic permeability, such as ferrite. At the opening 8*a* of core 8, a distance k between cut surfaces 8*b* is 5 mm. A thickness of the air layer 6 formed between the core 8 and fixing belt 1, i.e. a distance r between the core 8 and fixing belt 1, is 1 mm.

Figure 3:
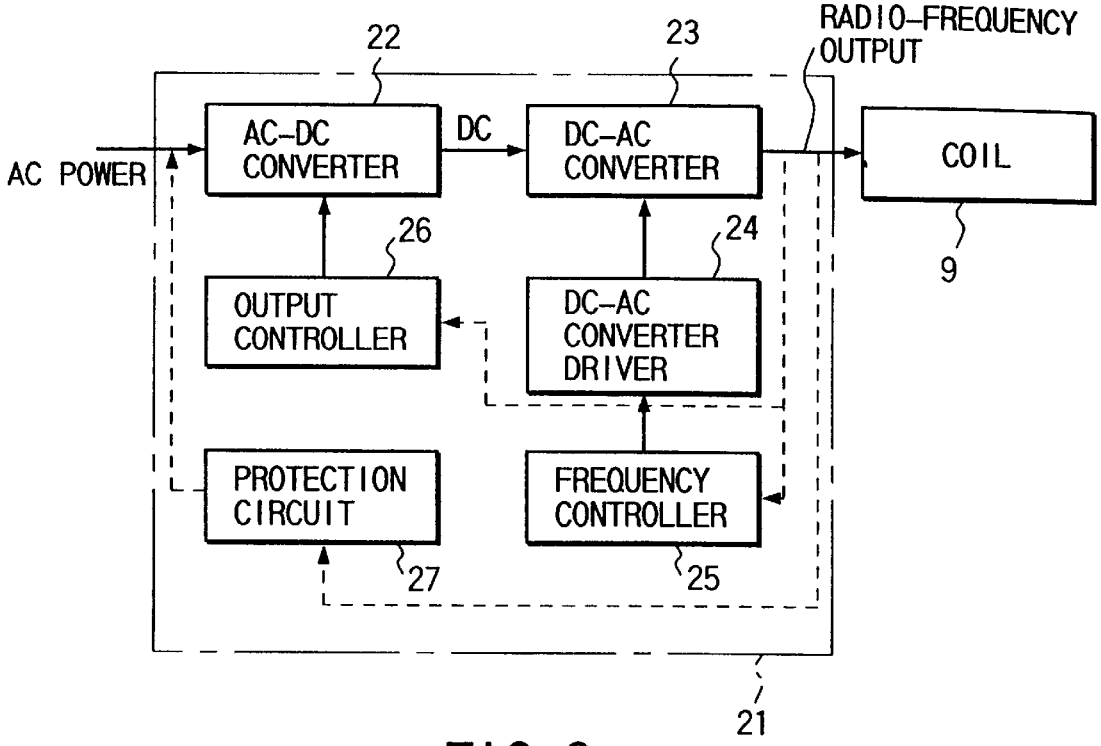
FIG. 3 is a block diagram showing an example of a radio-frequency output unit for supplying a radio-frequency output to the magnetism generator shown in FIG. 2.

In the magnetism generator 7 shown in FIG. 2, a radio-frequency output of a predetermined frequency is applied to the coil 9 by a radio-frequency output unit shown in FIG. 3, and thus a radio-frequency current flows through the coil 9. The radio-frequency current causes a magnetic flux of a predetermined intensity in the core 8. The frequency of the voltage applied from the radio-frequency output unit is set at, e.g. 20 kHz (kilohertz). The voltage and current at this time are set so as to produce an output of 800 W (Watt), though they depend on the material of the fixing belt 1.

The magnetic flux produced in the core 8 is guided from the opening 8*a* to the fixing belt 1. As a result, an eddy current occurs in the portion of the fixing belt 1, which is located near the rotary contact portion S where the fixing belt 1 is in contact with the pressure roller 10. Well-known Joule heat occurs in the fixing belt 1 due to the eddy current and the specific resistance of the belt 1. Accordingly, the fixing belt 1, which passes through the rotary contact portion S, is heated at a predetermined temperature only while it is passing through the rotary contact portion S. The eddy current occurring in the belt 1 has a distribution in the thickness direction of the belt 1 in accordance with the material of the belt 1. It is necessary, therefore, to set the thickness of the fixing belt 1 at a value close to the specific depth of permeation of eddy current which is determined by the material of the belt 1.

FIG. 3 is a schematic block diagram showing an example of a temperature control device (radio-frequency output unit) 21 for controlling the temperature of the fixing belt 1 of fixing device 100.

The radio-frequency output unit (temperature control device) 21 is an AC-AC converter type radio-frequency output unit which once converts an input power or a commercial AC voltage to a DC voltage and then outputs a necessary radio-frequency output. The circuit 21 includes:

- an AC-DC converter 22 for converting an input AC voltage to a DC voltage;
- a DC-AC converter (generally called "inverter") 23 for converting once again the input voltage AC/DC converted by the AC-DC converter 22 to an AC (radio-frequency) voltage;
- a DC-AC converter driver 24 for setting an output frequency at a predetermined frequency when the DC voltage output from the AC-DC converter 22 is converted once again to the radio-frequency voltage through the DC-AC converter 23;

a frequency controller 25 for monitoring the frequency of the radio-frequency output from the DC-AC converter 23 and controlling the frequency at which the driver 24 drives the DC-AC converter 23; and an output controller 26 for controlling the magnitude of the output to be supplied from the AC-DC converter 22 to DC-AC converter 23 in accordance with an output voltage to be output to the coil 9, when the input voltage is converted to the DC voltage through the AC-DC converter 22.

The commercial AC voltage is converted to the DC voltage and then converted once again to the radio-frequency voltage. Thus, the radio-frequency output for induction-heating the fixing belt 1 to the magnetism generator 7. The radio-frequency output from the DC-AC converter 23 is monitored by a protection circuit 27. An input of commercial AC voltage to the AC-DC converter 22 is shut off, where necessary, on the basis of the monitor result of the protection circuit 27.

Specifically, the frequency of the radio-frequency output applied to the coil 9 of magnetism generator 7 is set by the frequency controller 25. Thereby, when the DC output from the AC-DC converter 22 is converted to the radio-frequency (AC) output by the DC-AC converter 23, the number of pulses supplied to the gate of a switching element (not shown) provided within the driver 24 is set.

The radio-frequency output from the DC-AC converter 23 is applied to the coil 9 of magnetism generator 7, thereby producing an AC magnetic field with polarities switched at high frequency at and near the core 8. If the fixing belt 1 runs across the AC field, an eddy current is induced in the thickness direction of the belt 1 and the fixing belt 1 is heated by Joule heat.

Figure 4:
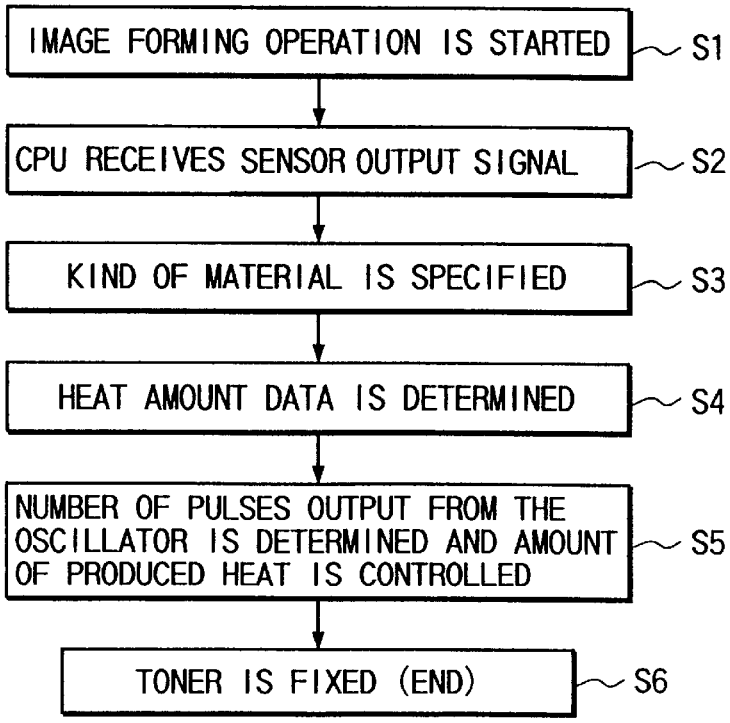
FIG. 4 is a flow chart illustrating fixing steps using the fixing device shown in FIGS. 1 to 3.
Figure 5:
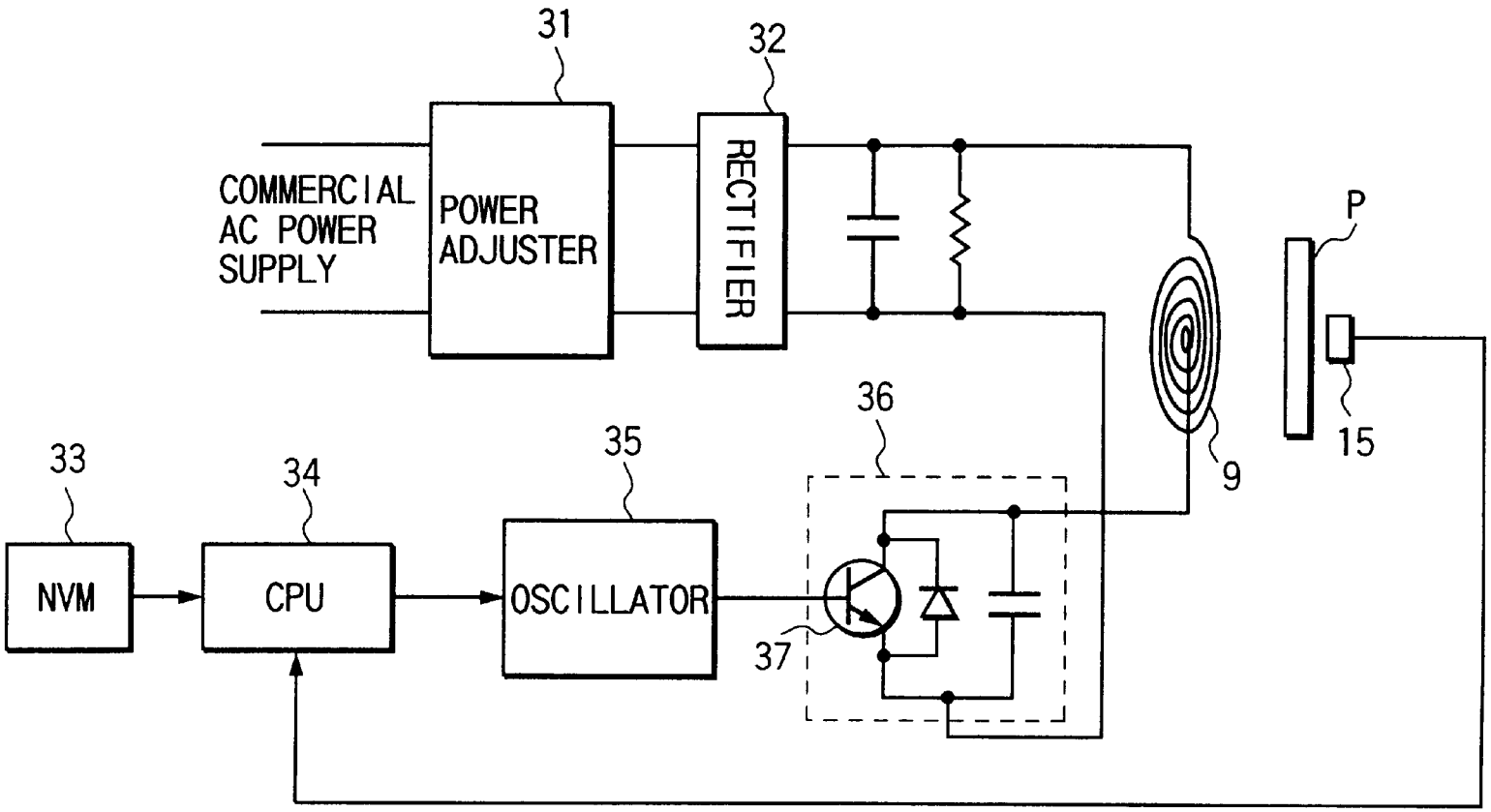
FIG. 5 is a block diagram showing an example of a control circuit for controlling the fixing device shown in FIG. 1.

FIG. 4 is a flow chart illustrating an example of a temperature control of the fixing belt 1 crossing the rotary contact portion S constituted by the fixing belt 1 and pressure roller 10 of the fixing device shown in FIG. 1. FIG. 5 is a schematic block diagram showing an example of a control circuit of the fixing device, which can perform the control illustrated in the flow chart of FIG. 4.

In FIG. 4, a copy key (not shown) of the image forming apparatus, i.e. copying machine (not shown) is depressed (step S1).

In step S1, a well-known image forming operation is started in the copying machine and a sheet P on which toner (toner image) T has been transferred is fed toward the convey guide 14 of fixing device 100. The sheet P passes by the material sensor 15 provided on the upstream side of the convey guide 14 in the direction of feeding of sheet P. A sensor output signal having a predetermined magnitude in accordance with the material of sheet P is output from the sensor 15 via an input circuit (not shown) to a main control circuit (CPU in FIG. 5) 34 of the control unit to be described later with reference to FIG. 5 (step S2).

In the CPU 34, the output of sensor 15 is compared to material data of various sheet-like materials P on which toner images are to be fixed, which material data is stored in a non-volatile memory (NVM, see FIG. 5) 33, in which data can be stored after assembly of the copying machine (not shown) or in a ROM (not shown). Specifically, the kind of material P is specified by the CPU 34. The materials on which toner images are to be fixed are, for example, plain paper, transparent-resin sheets for over-head projector (OHP), thick plain paper with low fixing properties, and the like (step S3).

In step S3, if the kind of the material P is specified, heat amount data determined for each kind of specified material P stored in the ROM or NVM (not shown) is read out (step S4).

On the basis of heat amount data read out in step S4, the amount of heat applied to the fixing belt 1 from the coil 9 of magnetism generator 7 is controlled. Specifically, the number of pulses to be output from the oscillator 35 (corresponding to the frequency controller 25 of the radio-frequency output unit 21 shown in FIG. 3) is controlled at an optimal value in accordance with the kind of material P (step S5). The material P passing by the rotary contact portion S is heated up to an optimal temperature by the belt 1 crossing the rotary contact portion S between the pressure roller 10 and fixing belt 1, and toner T is fixed (step S6, "END").

The control method in steps Si to S6 is called "feed-forward control".

Referring to FIG. 5, the control circuit will now be described in comparison with the flow chart of FIG. 4. The amount of passage power of an AC voltage supplied from a commercial AC power supply is adjusted by a power adjuster 31 and then rectified by a rectifier 32 to a DC. One DC output from the rectifier 32 is connected to one end of the coil 9 of magnetism generator 7. The other DC output from the rectifier 32 is connected to an output side of a switching element 37 (corresponding to the DC-AC converter 23) of radio-frequency output unit 21 shown in FIG. 3 of an oscillator 35 and an output control circuit (generally called an inverter circuit) 36 (corresponding to the driver 24 of radio-frequency output unit 21 shown in FIG. 3).

Subsequently, sheet P, on which toner T has been transferred and which is being conveyed to the convey guide 14, passes by the material sensor 15. As a result, a sensor output signal having a predetermined magnitude in accordance with the material of sheet P is input to the CPU 34 from the sensor 15 via an input circuit (not shown). Specifically, on the basis of the sensor output 15, the CPU 34 specifies the kind of sheet material P which is stored in the NVM 33 (or ROM not shown) and the corresponding heat amount data of the sheet P is read out of the ROM not shown (or NVM 33).

On the basis of the read-out heat quantity data, the CPU 24 changes the number of pulses output by the oscillator 35 (frequency controller 25) to a predetermined value. Thus, the time when the switching element 37 of output control circuit 36 is turned on is varied (i.e. the timing at which the driver 24 drives the DC-AC converter driver 23 is successively varied).

Accordingly, the switching element 37 supplies a high-frequency output of a predetermined frequency to the coil 9 of magnetism generator 7 by a time period determined by the number of supplied pulses. Thereby, an optimal eddy current corresponding to the kind of material P occurs at the rotary contact portion S of the fixing belt 1, and the various kinds of material P and toner T on the material P, which pass by the rotary contact portion S, are heated at an optimal temperature and toner is fixed.

With the above-described feed-forward control, the temperature of the belt 1 passing by the rotary contact portion S can be set at an optimal value even if the responsivity of thermistor 12 does not follow a quick temperature rise when the material P passes by the rotary contact portion S.

Specifically, there is no need to undesirably reduce the power supplied to the fixing belt 1 in accordance with the responsivity of the thermistor, or to decrease the variation in temperature (i.e. increase the time needed for heating) by providing the fixing belt with an excessive thermal capacity. Furthermore, there is no need to decrease the fixing speed in advance in accordance with the kind of sheet P.

In other words, since the fixing belt 1 is thinned, the thermal capacity can be reduced and thus the thermal responsivity (i.e. responsivity at the time of temperature rise) is improved and the fixing speed is increased.

As stated above, in the fixing device 100, the rotary contact portion S is constituted by the metallic belt 1 with less thermal capacity and the pressure roller 10 for applying a predetermined pressure to the metallic belt 1. Only that portion of the metallic belt 1, which is passing by the rotary contact portion S, is heated in a short time period by radio-frequency induction heating. In addition, the amount of heat produced by the fixing belt 1, which is passing by the rotary contact portion s, is controlled on the basis of the material of sheet P. Thereby, there is no need to vary the fixing speed in accordance with the kind of sheet P.

Modifications of the embodiment shown in FIGS. 1 to 5 will now be described. Referring back to FIG. 1, the second thermistor 13 is provided on an outer periphery of the pressure roller 10 of fixing device 100.

The second thermistor 13 constantly detects the temperature of the outer periphery of the pressure roller 10.

It is thus possible to optimally vary, in accordance with the temperature variation of the outer periphery of pressure roller 10, the magnitude of the eddy current produced in the fixing belt 1 by the radio-frequency current supplied from the coil 9 of magnetism generator 7. Accordingly, the amount of heat produced at the rotary contact portion between the fixing belt 1 and pressure roller 10 can be controlled at all times.

In other words, in a fixation start time period immediately after the sheet P has begun to pass by the rotary contact portion S, the pressure roller 10 has not been heated although the temperature of the fixing belt 1 passing by the rotary contact portion S has reached a predetermined level.

On the other hand, when plural sheets P are successively conveyed, the temperatures of the belt 1 and pressure roller 10 gradually rise at the rotary contact portion S. Consequently, the amount of heat applied from the pressure roller 10 to sheets P increases.

When plural sheets P are successively fixed, it is thus necessary to control the magnitude of the radio-frequency output supplied to the coil 9 of magnetism generator 7 in accordance with the number and material of sheets P on which toner is successively fixed, so that the sum of the amount of heat supplied to the sheet P from the fixing belt 1 and pressure roller 10 at the rotary contact portion S and the amount of heat received by the sheet P from the pressure roller 10 near the rotary contact portion S may not exceed the amount of heat to be supplied to the sheet P at the rotary contact portion S. The NVM 33 (or ROM not shown) prestores heat amount data set on the basis of the number of sheets for fixing (i.e. time for supplying power to coil 9) and a temperature rise of the roller 10 and/or heat amount data set on the basis of the kinds and number of sheets P for fixing (i.e. time for supplying power to coil 9) and a temperature rise of roller 10, which data is required when sheets P are successively conveyed for fixing toner thereon.

As has been described with reference to FIGS. 3 to 5, when sheets P are successively conveyed for the fixing of toner, the heat amount data associated with the number of sheets for fixing of toner (i.e. time for supplying power to coil 9) and the temperature rise of roller 10 and/or the heat amount data associated with the kinds and number of sheets for fixing of toner (i.e. time for supplying power to coil 9) and the temperature rise of roller 10 is read out of the NVM 33 by the CPU 34, and the number of pulses output from the oscillator 35 (frequency controller 25) is set at a predetermined number of pulses specified in association with the time of power supply to the coil 9 and the kind of sheets P.

Thus, the time at which the switching element 37 of output control circuit 36 is turned on is varied (the timing at which the driver 24 drives the DC-AC converter 23 is successively varied).

Subsequently, the switching element 37 supplies a high-frequency output of a predetermined frequency to the coil 9 of magnetism generator 7 by a time period determined by the number of supplied pulses. Thereby, an optimal eddy current corresponding to the kind of material P and the number of successively conveyed sheet s occurs at the rotary contact portion S of the fixing belt 1, and the various kinds of material P and toner T on the material P, which pass by the rotary contact portion S, are heated at an optimal temperature and toner is fixed.

As described above, when the fixing steps are repeated successively, the temperature of the pressure roller 10 is monitored and the magnitude of the radio-frequency output to be applied to the rotary contact portion S is controlled. Thus, an optimal heating process corresponding to a given order of conveyance of sheets P can be achieved. Accordingly, in the successive fixing steps, the same temperature conditions as for the first toner-fixed sheets P can be applied to subsequently conveyed sheets P. Thereby, no offset of image (toner) occurs on an n-th sheet P for toner fixation.

Another embodiment of the invention will now be described.

Figure 6:
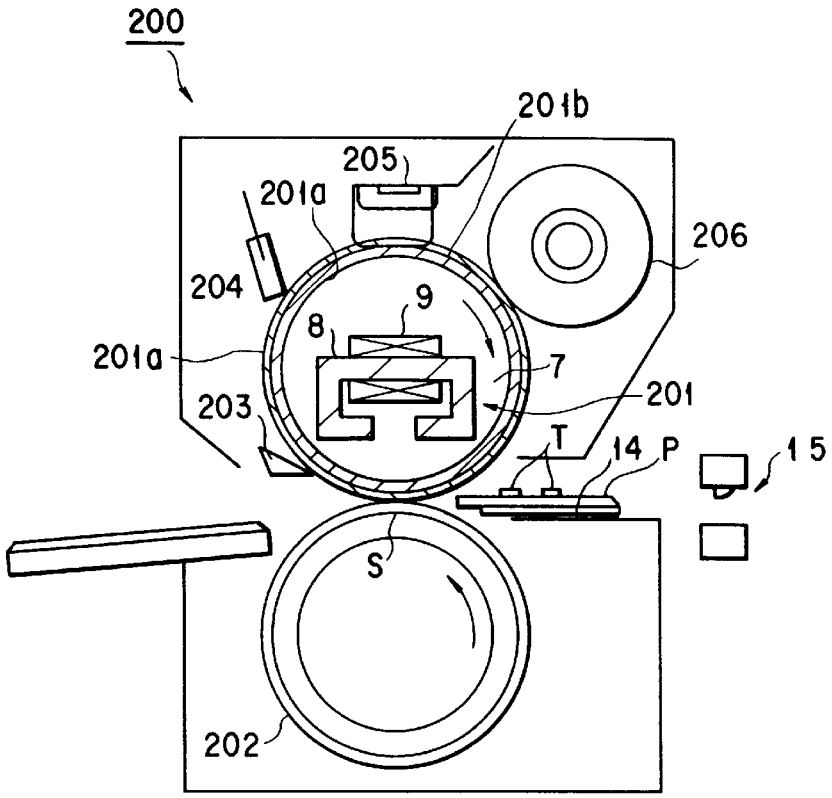
FIG. 6 is a schematic view showing another embodiment of the fixing device shown in FIG. 1.

FIG. 6 schematically shows a fixing device different from the fixing device shown in FIG. 1. The fixing device 200 has a heat roller 201 having a diameter of, e.g. 30 mm. The heat roller 201 is rotated in the direction of the arrow by a driving source (not shown). The heat roller 201 is a metallic roller formed such that a surface of a heat-insulative hollow roller 201*a* with a thickness of 1.5 mm is coated with a metallic layer 201*b* having a predetermined thickness, for example, by a plating process. The metallic layer 201*b* is formed of a high heat conductivity material, e.g. iron. In this example, the thickness of the metallic layer 201*b* is set at 80 $\mu$m or less. The surface of the metallic layer 201*b* is coated with a releasing layer 201*c* with a predetermined thickness of, e.g. fluororesin, silicone resin or silicone rubber, as a releasing layer for preventing adhesion of toner on the metallic layer 201*b*.

On the other hand, the pressure roller 202 is an elastic roller formed by coating an elastic material, such as silicone rubber or fluoro-rubber, with a predetermined thickness on the periphery of a shaft 202*a*.

A magnetism generator 7 includes a core 8 and a coil 9 is provided within the hollow roller 201*a* of heat roller 201. The magnetism generator 7 extends along the axis of the heat roller 201 and has a length substantially equal to the axial length of the heat roller 201. A detailed description of the magnetism generator 7 is omitted since it has the same structure as the structure already described with reference to FIGS. 1 and 2.

The pressure roller 202 disposed such that its axis is parallel to the axis (not shown) of the heat roller 201 is pressed by a pressing mechanism (not shown) onto a predetermined location of the outer periphery of the heat roller 201. When the heat roller 201 is rotated, the pressure roller 202 receives a propelling force from the heat roller 201 at the rotary contact portion S at which the pressure roller 202 is put in contact with the heat roller 201. Thus, the pressure roller 202 is rotated along with the heat roller 201. The size of the rotary contact portion S is set in a predetermined range in consideration of the pressure applied to the pressure roller 202 by the pressing mechanism (not shown) and the materials of the heat roller 201 and pressure roller 202.

On the downstream side of the rotary contact portion S in the rotational direction of the roller 201, a releasing claw

203, a cleaning member 204, a thermistor 205 and a releasing agent coating device 206 are arranged in the named order around the outer periphery of the heat roller 201 at predetermined positions. The releasing claw 203 releases the sheet P, which is attached to the roller 201 by fixed toner T, from the outermost releasing layer 201*c* of heat roller 201. The cleaning member 204 removes offset toner remaining on the heat roller 201 or contamination occurring from the sheet P (in particular, the amount of contamination being large when the sheet P is plain paper). The thermistor 205 detects the temperature of the periphery of the heat roller 201. The releasing agent coating device 206 applies an offset preventing releasing agent for reducing the possibility of adhesion of toner (on the heat roller 201).

In the fixing device 200 shown in FIG. 6, if the heat roller 201 is rotated in the direction of arrow by the driving force applied from the driving source (not shown), the outer periphery of the pressure roller 202 rotates accordingly at the same speed as the outer periphery of the heat roller 201. In addition, a roller of the releasing agent applying device 206 rotates in accordance with the rotation of the heat roller 201.

In the state in which the toner image T to be fixed is statically held on the material on which toner is to be fixed, i.e. a plain paper sheet or a transparent resin sheet for an over-head projector (OHP) P, the sheet is guided along the convey guide 14 to the rotary contact portion S constituted by the heat roller 201 and pressure roller 202. Since the material sensor 15 including the light emission element 15*a* and light reception element 15*b* and detecting the kind of sheet P guided to the rotary contact portion S along the convey guide 14 is disposed at a predetermined position of the convey guide 14, the material of sheet P guided to the rotary contact portion S is specified. Thus, the magnetism generator 7 generates a magnetic field of a predetermined intensity on the basis of a drive current set by a relationship between the material and fixing temperature, which are sensed by the sensor 15 and stored in a memory device to be described later with reference to FIG. 10, and the magnetism generator 7 heats the rotary contact portion S of heat roller 201. Accordingly, the sheet P and toner T on the sheet P passing by the rotary contact portion S are heated up to a predetermined temperature.

The sheet P guided to the rotary contact portion S passes by the rotary contact portion S, while carrying the molten toner image which was formed after the toner of the toner image carried by the sheet P itself came in contact with the heat roller 201 and was melted. At this time, a predetermined pressure is applied to the molten toner image by the heat roller 201 and pressure roller 202. Thus, the toner image is fixed on the sheet. In this case, the radio-frequency output is set so that the frequency of radio-frequency voltage applied to the coil 9 may be 10 kHz and the output may be 800 W. At this time, the surface temperature of the heat roller 201 is about 180° C.

Figure 7:
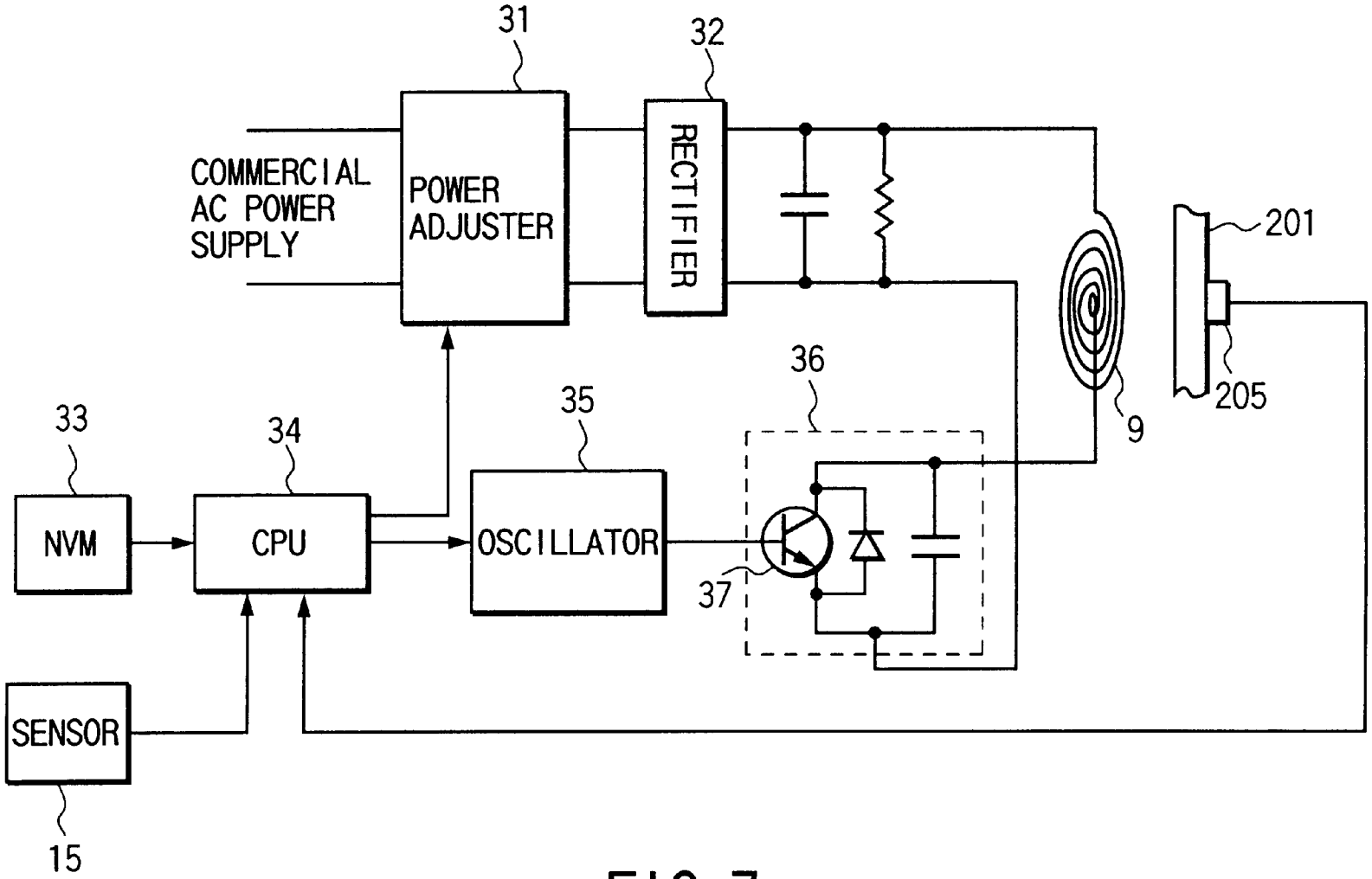
FIG. 7 is a block diagram showing an example of a control circuit for controlling the fixing device shown in FIG. 6.

FIG. 7 is a schematic diagram showing an example of a control circuit for controlling the fixing device 200 shown in FIG. 6. Since the control circuit shown in FIG. 7 has a structure similar to the structure of the control circuit shown in FIG. 5, common structural elements are denoted by like reference numerals and a detailed description thereof is omitted.

As is shown in FIG. 7, the amount of passage power of an AC voltage supplied from a commercial AC power supply is adjusted by a power adjuster 31 and then rectified by a rectifier 32 to a DC. One DC output from the rectifier 32 is connected to one end of the coil 9 of magnetism generator 7. The other DC output from the rectifier 32 is connected to an output side of a switching element 37 of an oscillator 35 (corresponding to the frequency controller 25 of radio-frequency circuit 21 shown in FIG. 3) and an output control circuit 36 (corresponding to the driver 24 of radio-frequency circuit 21 shown in FIG. 3).

Subsequently, the print key (not shown) of the copying machine (not shown) is turned on and the copying operation is started. Sheet P, on which toner T has been transferred, is conveyed to the rotary contact portion S.

On the other hand, an output or a temperature signal of the thermistor 205 put in contact with the outer periphery of the heat roller 201 is input to the CPU 34 via an input circuit (not shown).

The CPU 34 maintains the trigger control angle of the gate current to a thyristor (not shown) of the power adjuster 31 at a value near the upper limit within a predetermined range, until the output of the thermistor 205 reaches a predetermined set value (temperature). As is generally known, a thyristor receives a trigger at any time point of a phase of an AC input, and allows the AC input to pass through from a time when the thyristor receives the trigger till a time when the phase of the AC input reverses. The commercial AC voltage output from the power adjuster 31 is smoothed through the rectifier 32 and is applied to the coil 9 of magnetism generator 7. Subsequently, if it is detected by the thermistor 205 that the temperature of the heat roller 201 has reached a predetermined value, the CPU 34 carries out a control to reduce the trigger control angle of the gate current to the thyristor within a predetermined range. In addition, when a decrease in temperature has been detected from the output of the thermistor 205, the trigger control angle is increased within a predetermined range.

Accordingly, the temperature of the outer periphery of heat roller 201 continues to rise from a time when the print key is depressed to a time when the thermistor 205 indicates that the temperature of the outer periphery of heat roller 201 has reached the set value. When the temperature of the heat roller 201 has reached the set value, the efficiency of use of AC voltage from the commercial power supply decreases and thus an optimal temperature is maintained without an undesirable overshoot.

Accordingly, toner can be fixed at an optimal temperature on the sheet P passing by the rotary contact portion S with a simple structure and control, without using the feed-forward control as described in connection with the preceding embodiment with reference to FIGS. 1 to 5.

However, when the sheet P passes by the rotary contact portion S of fixing device 200 (i.e. sheet P being present in the region of rotary contact portion S), a steep temperature change occurs in the rotary contact portion S since the thermal capacity of the heat roller 201 is small. This temperature change is quick, compared to the time required until the region of the heat roller 201 passing by the rotary contact portion S is guided to the thermistor 205. Consequently, the temperature of the outer periphery of heat roller 201 decreases continuously.

Considering the above, like the above-described embodiment, the kind of sheet P guided to the rotary contact portion S is specified from an output of the material sensor 15, heat amount data (of the associated sheet P) is read out from the NVM 33, the oscillation frequency of the output from the oscillator 35 is altered on the basis of the heat amount data, and the number of pulses to the switching element 37 of output control circuit 36 is varied in accordance with the material of the sheet P. Thereby, a temperature variation of the rotary contact portion S (heat roller 201)

occurring when the sheet P passes by the rotary contact portion S can be suppressed.

In a case where a continuous copying operation (a copying operation for plural sheets) is instructed through the operation panel (not shown), the heat roller 201 (magnetism generator 7) may be continuously heated by the above-described power amount control so that the temperature of the outer periphery of the pressure roller 202 may be constant when no sheet P is present in the rotary contact portion S. Thereby, the fixing device with no decrease in fixing ratio can be provided without providing the heat roller 201 with a thermal capacity.

Figure 10:
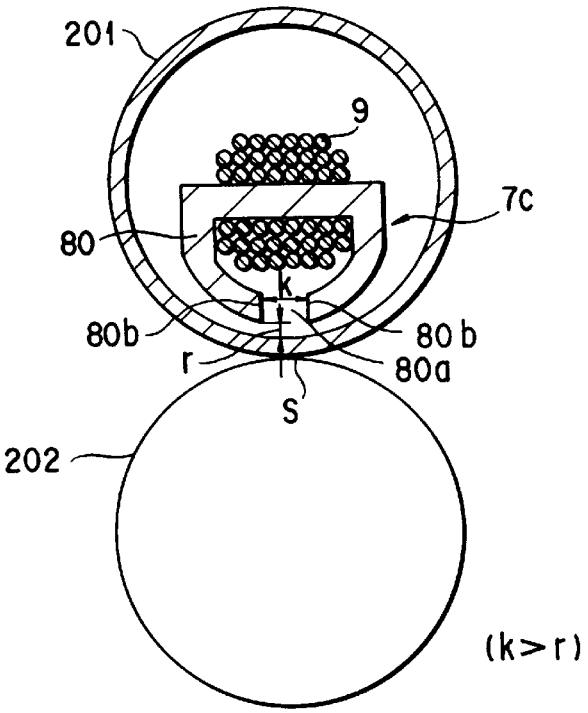
FIG. 10 is a schematic diagram showing another mode of the fixing device shown in FIG. 6.

As has been described above, according to the present invention, a fixing process with high efficiency of use of heat can be performed by direct heating utilizing induction heating, without providing the fixing belt 1 or heat roller 201 with a thermal capacity of a predetermined level. Moreover, a stable fixing process can be carried out irrespective of the kind of sheets P. In the meantime, as shown in FIG. 10, the shape of the core 80 of magnetism generator 70 (as distinguished from the above-described magnetism generator 7) on the side of the opening 80*a* may be curved in association with the radius of curvature of the inner wall of the hollow roller 201*a* of heat roller 201. In this case, needless to say, the distance between the core 80 and the inner wall of heat roller 201 can be reduced to a minimum. In addition, in the examples shown in FIGS. 2 and 12, the cut faces of the opening 8*a* (80*a*) of core 8 (80) are parallel to each other. However, the cut faces may be arranged to be directed to the rotary contact portion S.

When the rotary contact portion S between the fixing belt 1 (or heat roller 201 in FIG. 6) and the pressure roller 10 (or pressure roller 202 in FIG. 6) is heated, it is necessary that the center of heating coincide with the center of the rotary contact portion S. In addition, it is necessary that the shape and position of the core 8 be determined so that most of the magnetic field produced by the current supplied to the coil 9 may cross the rotary contact portion S.

The conditions for positioning the core 8 will now be described.

Figure 8:
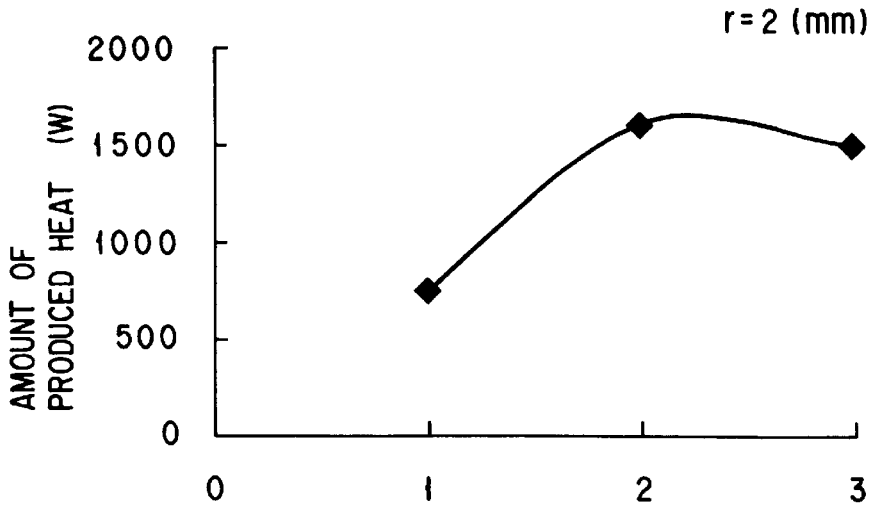
FIG. 8 is a graph showing the amount of produced heat for specifying a positional relationship between a magnetic force line induction section (leg portions) of the core of the magnetism generator shown in FIG. 2 and the heat producing bodies (the bodies to be heated; roller and belt)

FIG. 8 is a graph showing a relationship between a distance k between two cut faces 8*b* provided by the opening 8*a* of core 8 and a distance r between the core 8 and fixing belt 1 (object to be heated). The relationship between k and r is the same as in the embodiment shown in FIG. 2.

As is shown in FIG. 8, when k=1, 2 or 3 and r=2, the amount of heat (in terms of Watt) produced by the belt 1 is plotted. When k=1 and r=2, it is observed that the heat amount sharply decreases. The reason is that when the distance between the belt 1 to be heated and the core 8 is longer than the distance between the two cut faces of the core 8, the magnetic force lines emanating from one of the two cut faces do not extend to the belt 1 to be heated but to the other cut face.

Therefore, the core 8 must be disposed at a position where at least "k=r" is satisfied. It is actually preferable that the number of magnetic force lines crossing the object to be heated be large. In order to reduce the possibility that the magnetic force lines emanating from one of the two cut faces of core 8 extend to the other cut face, the distance k between the cut faces 8*b* of core 8 and the distance r between the core 8 and belt 1 are set so that condition "k>r" may be satisfied, and more preferably the value r may take a minimum value in such a range that the core 8 does not contact belt 1. In the example shown in FIG. 2, the above condition "k>r" is satisfied. The same applies to the modification shown in FIG. 10.

Figure 9:
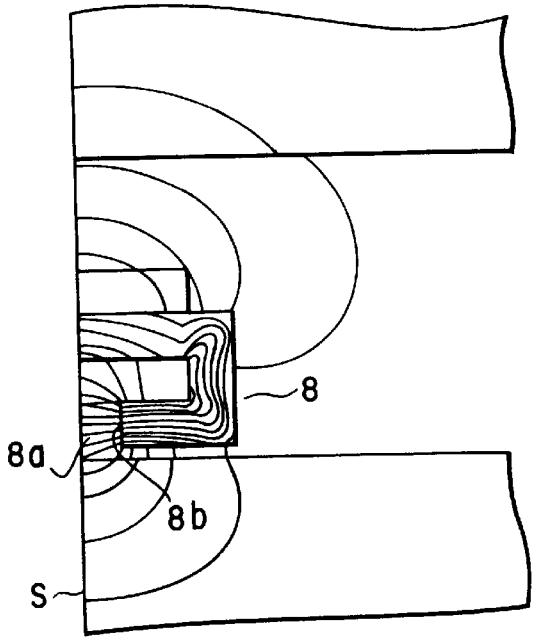
FIG. 9 is a schematic diagram showing an example of a distribution of magnetic lines produced around the core (magnetism generator) when the magnetism generator shown in FIG. 2 is disposed to satisfy the condition illustrated in FIG. 8.

FIG. 9 schematically shows an example of a distribution of magnetic force lines occurring around the core 8 (magnetism generator 7) in the fixing device in which the magnetism generator 7 shown in FIG. 2 is situated to satisfy the condition described with reference to FIG. 8.

Figure 11:
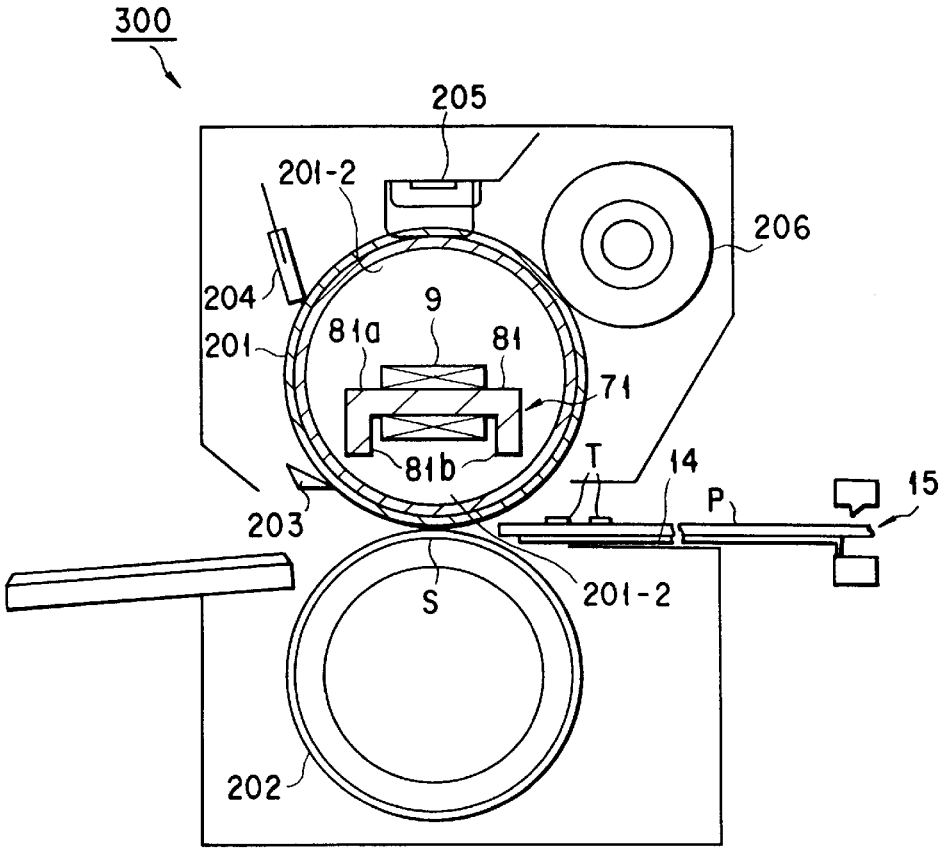
FIG. 11 is a schematic diagram showing still another mode of the fixing device shown in FIGS. 1, 6 and 10.

As is shown in FIG. 11, it is understood that when K>r and r=1 mm, magnetic force lines extend from the region crossing the cut faces of the core 8, i.e. the region of core 8 opposed to the belt (object to be heated), to the belt 1 (object to be heated) and that the magnetic force lines cross the belt 1. If the value k (distance between the cut faces 8*b* of core 8) is optimized, the magnetic force lines emanating from one of the cut faces do not deviate to the core 8 and extend to the other cut face in the region where the magnetic force lines cross the rotary contact face S. FIG. 11 shows the direction of magnetic force lines in a case where the distance k=5 mm in FIG. 2.

As regards the magnetism generator 7 (70) shown in FIGS. 1, 2, 6 and 10, the opening 8*a* (80*a*) of core 8 (80) is turned once again from the sides perpendicular to the region where the coil 9 is wound. Specifically, the core 8 is formed such that the cut faces of the opening 8*a* (80*a*) are close to each other at a distance k with respect to the direction of the cross section of the rotary contact portion S.

However, the cross section with two turns increases the cost of the core 8 (80*a*). In addition, the turned portions of the core 8 (80*a*) make difficult the work of winding the coil 9.

FIG. 11 schematically shows an example of the fixing device in which the above-mentioned problems in work and cost due to the above-mentioned cross section of the core can be solved. The structural elements common to those in FIG. 6 are denoted by like reference numerals and a detailed description thereof is omitted.

As is shown in FIG. 11, a fixing device 300 comprises a hollow cylindrical heat roller 201, a pressure roller 202 applying a predetermined pressure to the heat roller 201, a magnetism generator 71 provided within the heat roller 201, elements disposed around the heat roller 201, i.e. a releasing claw 203, a cleaning member 204, a thermistor 205 and a releasing agent applying device 206, and a convey guide 14.

In the magnetism generator 71, a core 81 includes a coil holding portion 81*a* having, e.g. a plate-like shape, and a plurality of magnetic force line guiding portions 81*b* extending perpendicular to the coil holding portion 81*a*. A coil 9 is integrally formed on the coil holding portion 81*a* by winding an insulator-coated copper wire with a diameter of 1.4 mm by a predetermined number of times.

Figure 13:
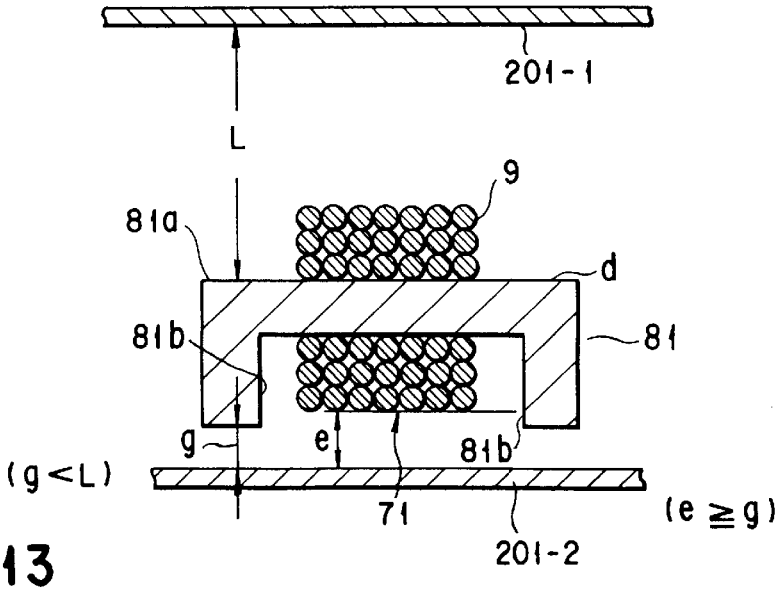
FIG. 13 is a cross-sectional view showing the rotary contact portion S, illustrating a relationship among the structural features of the magnetism generator applicable to the fixing device shown in FIGS. 11 and 12, the core peculiar to the magnetism generator and lead wires of the coil.
Figure 12:
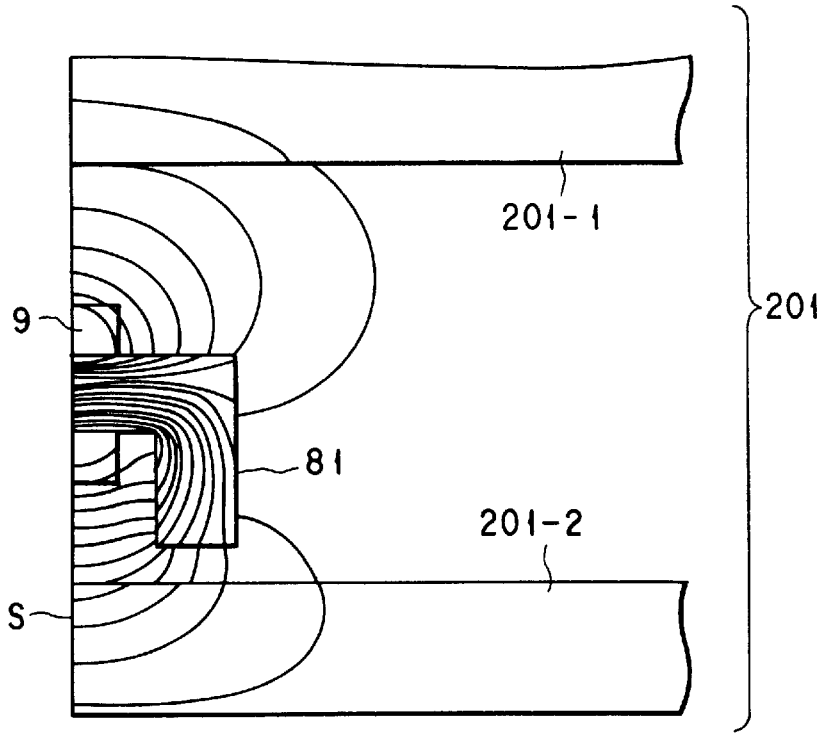
FIG. 12 is a schematic diagram showing a distribution of magnetic force lines produced around the rotary contact portion S from the magnetism generator built in the fixing device showing in FIG. 11.

FIG. 12 shows a magnetic force line distribution obtained from the magnetism generator 71 shown in FIG. 13, and the center of the distribution is set at the rotary contact portion S.

As is shown in FIGS. 11 and 12, magnetic force lines produced by the current supplied to the coil 9 are dense on the side of the magnetic force line guiding portion 81*b*. On the other hand, it is observed that magnetic force lines are present in a predetermined region (farther end) 201-1 of the heat roller 201 located away from the position where the core 81 (magnetism generator 71) of the heat roller 201. The presence of magnetic force lines at the farther end 201-1 of roller 201 reduces the efficiency of use of magnetic force lines, i.e. the ratio of magnetic force lines contributing to the heat generation in the rotary contact portion S to all magnetic force lines generated by the magnetism generator 71. Moreover, since the magnetic force lines present at the farther end 201-1 of roller 201 undesirably heat the portion of the heat roller 201, other than the rotary contact portion S, an error occurs in temperature data detected by the thermistor 205 provided around the roller 201.

FIG. 13 is a schematic cross-sectional view of the rotary contact portion S, illustrating the relationship between the structural feature of the magnetism generator 71 available in the fixing device shown in FIGS. 11 and 12, the core 81 peculiar to the magnetism generator 71, and the leas wire forming the coil 9.

In FIG. 13, gap g is a distance between the magnetic force line guiding portion 81*b* of core 81 and a region 201-2 on the inner surface of roller 201 which is closest to the end portion of the guiding portion 81*b*, and distance L is a distance between a region 201-1 (substantially equal to the farther end in FIG. 12) on the inner surface of roller 201 opposed to the region closest to the end portion of the guiding portion 81*b* and the surface of the coil holding portion 81*a* of core 81, which surface is opposed to the farther end 201-1 of roller 201. The efficiency of use of magnetic force lines can be enhanced by determining the position of core 81 and the length of the magnetic force line guiding portion 81*b* so as to satisfy at least the condition, L>g.

Figure 14:
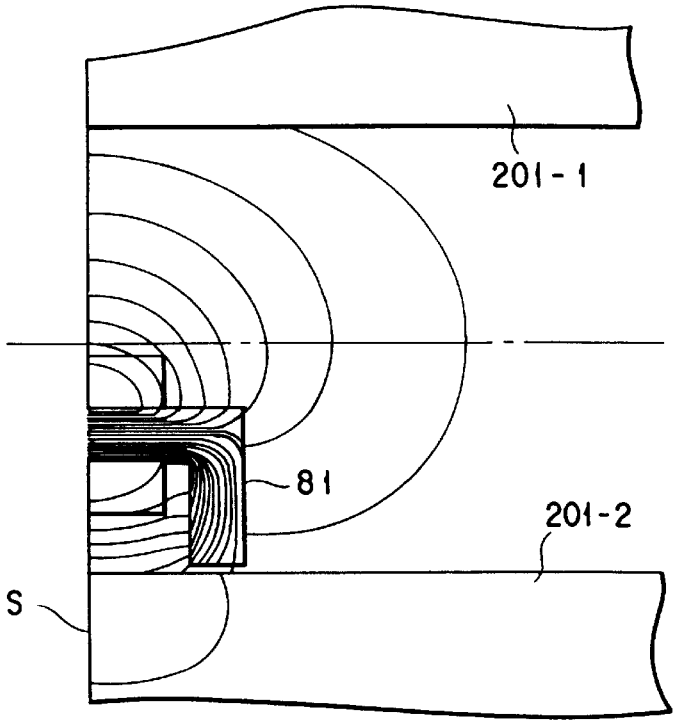
FIG. 14 is a schematic diagram showing an example of a distribution of magnetic force lines produced from the core shown in FIG. 13.

More preferably, when all winding of coil 9 provided on the holding portion 81*b* of core 81 is positioned on the side of the magnetic force line guiding portion 81*b* of core 81 with respect to ½ of the distance between the opposed faces 201-2 and 201-1 of heat roller 201, as shown in FIG. 14, it is understood that the error caused in the temperature data output from the thermistor 205 by the magnetic force lines acting on the farther end 201-1 falls within a predetermined range.

Under the condition for the position of core 81 as shown in FIG. 14, the heat use efficiency expressed by $$\eta = \frac{\text{amount of heat obtained at rotary contact portion } S \text{ and thereabouts}}{\text{sum of heat produced by heat roller 201}}$$

can be increased to 87.7%. In a comparative example shown in FIG. 15, in which the center of the coil holding portion 81*a* of core 81, as viewed in a direction parallel to the rotary contact portion S, coincides with an almost middle point of the distance between the opposed inner faces 201-2 and 201-1 of heat roller 201, the heat use efficiency η'=64.4%.

Figure 15:
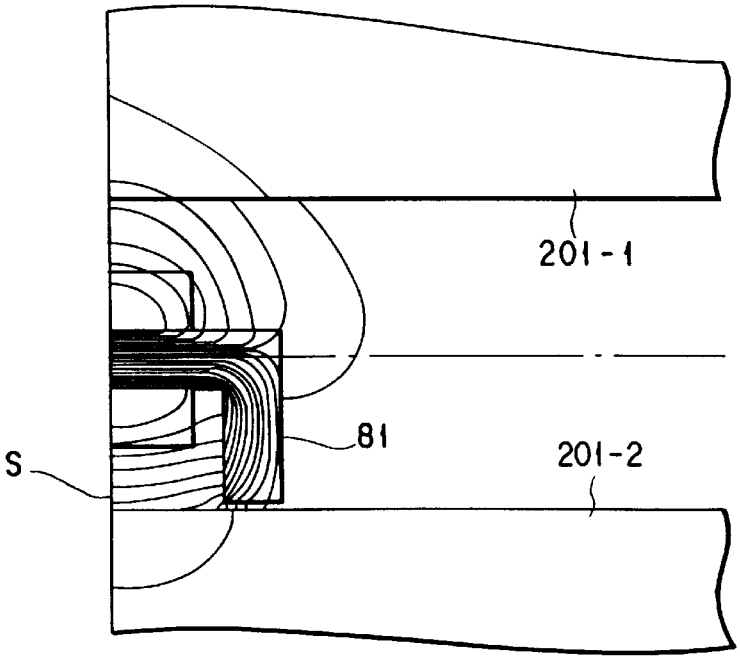
FIG. 15 is a schematic diagram showing an example of the core having a magnetic force line distribution, which is to be compared to the magnetic force line distribution shown in FIG. 14.

FIGS. 16A and 17A, 16B and 17B and 16C and 17C are schematic views illustrating the relationship between the core 81 described with reference to FIG. 15 and the lead wire forming the coil 9. The following description relates to a structure of the coil 9 (magnetism generator) which is advantageous in making the center of the rotary contact portion S agree with the center of heat generation.

Figure 16A:
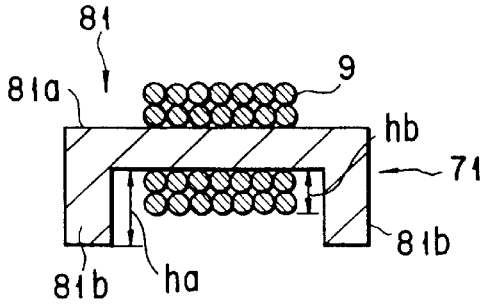
FIGS. 16A and 16B are schematic diagrams showing the features of the arrangement of the coil (shape of winding) which may occur with respect to the arrangement between the coil and core illustrated in FIG. 13.
Figure 17A:
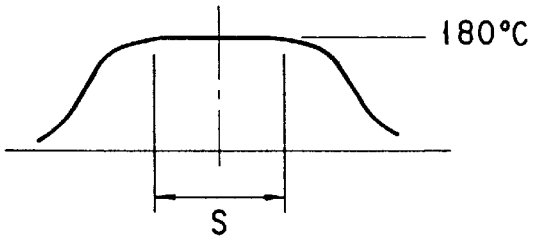
FIGS. 17A and 17B are schematic views showing distributions of heat produced by the rotary contact portion in association with the arrangements of the coil shown in FIGS. 16A and 16B.

As is shown in FIG. 16A, that portion of the lead wire forming the coil 9, which is located on the side of the magnetic force line guiding portion 81*b* of core 81, is flat. A substantially flat temperature distribution of the rotary contact portion S, as shown in FIG. 17A, is obtained if the condition, ha>hb, is satisfied. In this condition, hb is a distance between the surface of coil holding portion 81*a*, which is in contact with the lead wire, and that portion of the stacked lead wire, which is farthest from the holding portion 81*a*. On the other hand, ha is a distance between the roller-side end portion of magnetic force line guiding portion 81*b* and that surface of the coil holding portion 81*a* which is in contact with the lead wire.

Figure 16B:
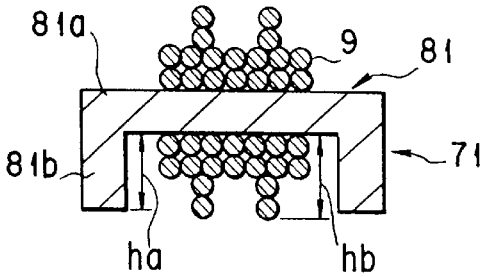
Figure 17B:
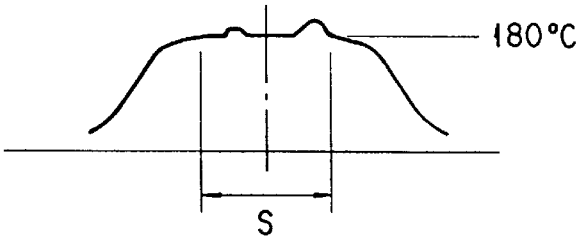

On the other hand, in FIG. 16B, that portion of the lead wire forming the coil 9, which is located on the side of the magnetic force line guiding portion 81*b* of core 81, is wound irregular. If the relationship, ha<hb, is established between the distance ha defined in FIG. 16B and the distance hb between the surface of coil holding portion 81*a*, which is in contact with the lead wire, and that portion of the stacked lead wire, which is farthest from the holding portion 81*a*, the temperature distribution of the rotary contact portion S exhibits projecting points associated with the irregular arrangement of the lead wire of coil 9, as shown in FIG. 17B. This temperature distribution is contrary to the purpose of obtaining a uniform temperature distribution at the rotary contact portion S. Moreover, when toner T is fixed on the sheet P, the fixing ratio will deteriorate.

It is thus preferable that the lead wire is wound on the core 81 to form the coil 9 so as to meet the conditions, ha>hb, as shown in FIG. 16A.

With this structure, the magnetic force line distribution penetrates the region surrounded by the magnetic force line guiding portion 81*b* and coil holding portion 81*a*, and the temperature of the rotary contact portion rises uniformly.

Figure 18:
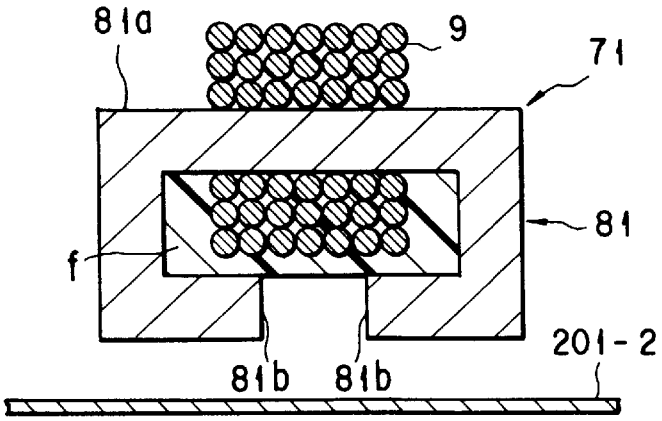
FIG. 18 is a schematic diagram showing an example wherein the shape of the core is varied in connection with the arrangement between the coil and core shown in FIG. 16A.

The structure shown in FIG. 16A is also advantageous in the structure, as shown in FIG. 18, wherein the end portions of magnetic force line guiding portions 81*b* extending perpendicular to the coil holding portion 81*a* of core 81 are turned to face each other.

FIG. 18 shows a schematic view of the coil arrangement of the core 81. In FIG. 18, those positions of the lead wire which are in the core 81 are encompassed with resin f. The wire (coil 9) is thus secured to the core 81 and protrusion of any wire will be prevented.

As has been described above, a conductor forming the coil is arranged within a region f surrounded by the magnetic force line guiding portions of the core, on which the conductor is wound, and the coil holding portion, such that the arrangement of the conductor has not irregularity. Thereby, the rotary contact portion S can be heated uniformly (the rotary contact portion S being provided with a heat distribution with no temperature variance).

In FIGS. 11 to 18, the heat roller has been described as heating means of the fixing device. The same, however, is applied to the above-described belt-type fixing device.

According to the above-described embodiments, a uniform distribution of heat produced by induction heating can be obtained with no undesirable peaks. Therefore, the heating condition for the toner heated at the rotary contact portion and the sheet can be improved and the fixing properties are enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device comprising:

a first rotary contact member formed of an electrically conductive material and rotated in a predetermined direction;

a second rotary contact member put in contact with the first rotary contact member under a predetermined pressure, a rotary contact region for fixing a developer image on a material on which the developer image is to be formed, being formed between the first rotary contact member and the second rotary contact member;

an oscillator that generates pulses according to a kind of the material; and an induction heating unit that heats the first rotary contact member to fix the developer image on the material according to the number of pulses supplied from the oscillator.

2. The fixing device according to claim 1, wherein the induction heating unit includes a magnetism generator and an AC-AC converter that provides a voltage of a predetermined frequency to the magnetism generator.

3. The fixing device according to claim 2, further comprising:

a material sensor that detects the kind of the material conveyed to the rotary contact region;

a memory unit that stores data on the amount of heat to be output by the induction heating unit, the data corresponding to the kind of the material; and a controller reads out from the memory unit the heat amount data corresponding to the kind of the material detected by the material sensor, thereby controlling the induction heating unit.

4. The fixing device according to claim 3, wherein the controller controls the number of pulses applied to a DC-AC converting unit of the AC-AC converter on the basis of the heat amount data read out from the memory unit.

5. The fixing device according to claim 2, further comprising:

a temperature sensor that detects a degree by which the temperature of one of the first and second rotary contact members has risen due to continuous heating of the rotary contact region by the induction heating unit;

a memory unit that stores data on the amount of heat to be output by the induction heating unit, the data corresponding to the temperature detected by the temperature sensor; and a controller reads out from the memory unit the heat amount data corresponding to the temperature detected by the temperature sensor, thereby controlling the induction heating unit.

6. The fixing device according to claim 5, wherein the controller controls the number of pulses applied to a DC-AC converting unit of the AC-AC converter on the basis of the heat amount data read out from the memory unit.

7. The fixing device according to claim 2, further comprising:

a material sensor that detects the kind of the material conveyed to the rotary contact region;

a temperature sensor that detects a degree by which the temperature of one of the first and second rotary contact members has risen due to continuous heating of the rotary contact region by the induction heating unit;

a first memory unit that stores data on the amount of heat to be output by the induction heating unit, the data corresponding to the kind of the material;

a second memory unit that stores data on the amount of heat to be output by the induction heating unit, the data corresponding to the temperature detected by the temperature sensor; and a controller reads out from the respective first and second memory units the heat amount data corresponding to the kind of the material detected by the material sensor and the heat amount data corresponding to the temperature detected by the temperature sensor, thereby controlling the induction heating unit.

8. The fixing device according to claim 7, wherein the controller controls the number of pulses applied to a DC-AC converting unit of the AC-AC converter on the basis of the heat amount data read out from said first memory unit and the second memory unit.

9. The fixing device according to claim 1, wherein the induction heating unit includes a coil supplied with a current of a predetermined magnitude and a magnetic field generating unit having a core for guiding magnetic force lines produced when the current has been supplied to the coil, and wherein the induction heating unit is situated in a region inside one of the first and second rotary contact members.

10. A fixing device comprising:

a first rotary contact member formed of an electrically conductive material and rotated in a predetermined direction;

a second rotary contact member put in contact with the first rotary contact member under a predetermined pressure, a rotary contact region for fixing a developer image on a material on which the developer image is to be formed, being formed between the first rotary contact member and the second rotary contact member;

an oscillator for generating pulses according to a kind of the material; and an induction heating unit that heats the first rotary contact member to fix the developer image on the material according to the number of pulses supplied from the oscillator, wherein the induction heating unit includes a coil supplied with a current of a predetermined magnitude and a magnetic field generating unit having a core having two end portions for guiding magnetic force lines produced when the current has been supplied to the coil, wherein both end portions of the core of the magnetic field generating unit are bent toward the rotary contact member located close to the core, thus constituting magnetic force line guiding portions, and wherein a distance between bent portions of the magnetic force line guiding portions is greater than a distance between the rotary contact member and those portions of the end portions of the magnetic force line guiding portions, which are closest to the rotary contact member.

11. The fixing device according to claim 10, wherein a distance between a given surface of the core opposed to a side on which the guiding portions are extended and the rotary contact member of the opposed side is greater than a distance between the rotary contact member and those portions of the end portions of the magnetic force line guiding portions, which are closest to the rotary contact member.

12. The fixing device according to claim 10, wherein the coil is wound in a region surrounded by the magnetic force line guiding portions of the core.

13. The fixing device according to claim 12, wherein in a case where end portions of the magnetic force line guiding portions of the core have bent portions, the coil is wound in a region surrounded by the magnetic force line guiding portions and the bent portions.

14. The fixing device according to claim 12, wherein the coil is wound to have a flat outer shape.

15. The fixing device according to claim 14, wherein the coil is wound to have a flat outer shape.

16. A fixing device comprising:

a first rotary contact member formed of an electrically conductive material and rotated in a predetermined direction;

a second rotary contact member put in contact with the first rotary contact member under a predetermined pressure, a rotary contact region for fixing a developer image on a material on which the developer image is to be formed, being formed between the first rotary contact member and the second rotary contact member;

an oscillator for generating pulses according to a kind of the material; and induction heating means for heating the first rotary contact member to fix the developer image on the material according to the number of pulses supplied from the oscillator.

* * * * *